US009014411B2

(12) United States Patent
Rodgers

(10) Patent No.: US 9,014,411 B2
(45) Date of Patent: Apr. 21, 2015

(54) SPEAKER GRILLE AND ASSEMBLY

(71) Applicant: Harman International Industries, Inc., Stamford, CT (US)

(72) Inventor: Derrick Rodgers, Altadena, CA (US)

(73) Assignee: Harman International Industries, Inc., Stamford, CT (US)

( * ) Notice: Subject to any disclaimer, the term of this patent is extended or adjusted under 35 U.S.C. 154(b) by 20 days.

(21) Appl. No.: 13/933,502

(22) Filed: Jul. 2, 2013

(65) Prior Publication Data

US 2015/0010194 A1 Jan. 8, 2015

(51) Int. Cl.
*H04R 1/02* (2006.01)

(52) U.S. Cl.
CPC ..... *H04R 1/023* (2013.01); *H04R 2201/029* (2013.01)

(58) Field of Classification Search
CPC .. B60R 11/0217; B60R 11/0223; H04R 1/02; H04R 1/021; H04R 1/023; H04R 1/025; H04R 1/345; H04R 1/44; H04R 1/2811; H04R 1/1026; H04R 2201/021; H04R 5/02
USPC ..... 381/391; 181/148, 149, 198, 199
See application file for complete search history.

(56) References Cited

U.S. PATENT DOCUMENTS

| | | | | |
|---|---|---|---|---|
| 4,031,318 | A | 6/1977 | Pitre | |
| 4,673,057 | A * | 6/1987 | Glassco | 181/199 |
| 4,843,624 | A | 6/1989 | Rashak | |
| 4,974,698 | A * | 12/1990 | Smith | 381/391 |
| 5,652,413 | A | 7/1997 | Mulera | |
| D434,750 | S | 12/2000 | Childers et al. | |
| 6,354,397 | B1 * | 3/2002 | Combest et al. | 181/199 |
| 6,845,840 | B2 | 1/2005 | Cowan et al. | |
| 6,978,030 | B2 | 12/2005 | Reich | |
| D611,450 | S | 3/2010 | Miyazaki | |
| 8,488,817 | B2 * | 7/2013 | Mittleman et al. | 381/391 |
| D691,592 | S | 10/2013 | Lum et al. | |

(Continued)

FOREIGN PATENT DOCUMENTS

| | | | |
|---|---|---|---|
| DE | 4345080 | A1 | 7/1994 |
| JP | S56111632 | A | 9/1981 |

(Continued)

OTHER PUBLICATIONS

European Patent Office, Partial Search Report for the corresponding European Patent Application No. 14175309.5 mailed Aug. 20, 2014.

(Continued)

*Primary Examiner* — Brian Ensey
(74) *Attorney, Agent, or Firm* — Brooks Kushman P.C.

(57) ABSTRACT

A speaker grille is provided including a front portion capable of sound transmission and side portions extending from the front portion. Each side portion includes an edge and a projection that extends beyond the edge, where each side portion has a substantially similar capability for sound transmission as the front portion. In one embodiment, the speaker grille comprises a perforated metal material, a fabric cloth material attached to the perforated metal material on an interior surface of the grille, and a metal cloth material attached to the fabric cloth material such that the fabric cloth material is disposed between the metal cloth material and the perforated metal material.

20 Claims, 4 Drawing Sheets

(56) References Cited

U.S. PATENT DOCUMENTS

D695,269 S 12/2013 Carpenter et al.
D704,679 S 5/2014 Asaka et al.

FOREIGN PATENT DOCUMENTS

JP S5946081 U 3/1984
JP S6163192 A 4/1986

OTHER PUBLICATIONS

European Patent Office, Extended European Search Report for the corresponding European Patent Application No. 14175309.5 mailed Dec. 17, 2014.

* cited by examiner

SPEAKER GRILLE AND ASSEMBLY

TECHNICAL FIELD

Embodiments relate to a speaker grille and speaker assembly, such as for a wide angle coverage speaker.

BACKGROUND

Speaker grilles are designed to protect loudspeaker drivers from mechanical impact, as well as to prevent ambient dust from accumulating on the diaphragms thereof, while still allowing the sound to pass through the grille clearly. However, because the speaker grille is placed in the direct path of the loudspeaker driver, the grille interacts with the sound produced. This is especially problematic when the application involves providing high quality, full bandwidth sound evenly dispersed across a coverage area greater than 100 degrees.

SUMMARY

In at least one embodiment, a speaker grille is provided including a front portion capable of sound transmission and side portions extending from the front portion. Each side portion includes an edge and a projection that extends beyond the edge, where each side portion has a substantially similar capability for sound transmission as the front portion.

In at least another embodiment, a speaker grille is provided including a body constructed from a perforated metal material, the body having an interior surface, a fabric cloth material attached to the perforated metal material on the interior surface, and a metal cloth material attached to the fabric cloth material such that the fabric cloth material is disposed between the metal cloth material and the perforated metal material.

In at least another embodiment, a speaker assembly is provided including an enclosure arranged to receive at least one speaker therein, the enclosure having recesses on each side thereof. The speaker assembly further includes a speaker grille arranged to be mounted on the enclosure, the speaker grille including a front portion capable of sound transmission and side portions extending from the front portion. Each side portion includes an edge and a projection that extends beyond the edge, where the projections are arranged to be received in the enclosure recesses and each side portion has a substantially similar capability for sound transmission as the front portion.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Embodiments disclosed herein relate to a speaker grille and a speaker assembly including a speaker grille and enclosure. In one embodiment, the speaker grille and assembly may be used with a wide angle coverage speaker providing horizontal coverage of 120 degrees or greater.

Figure 2:
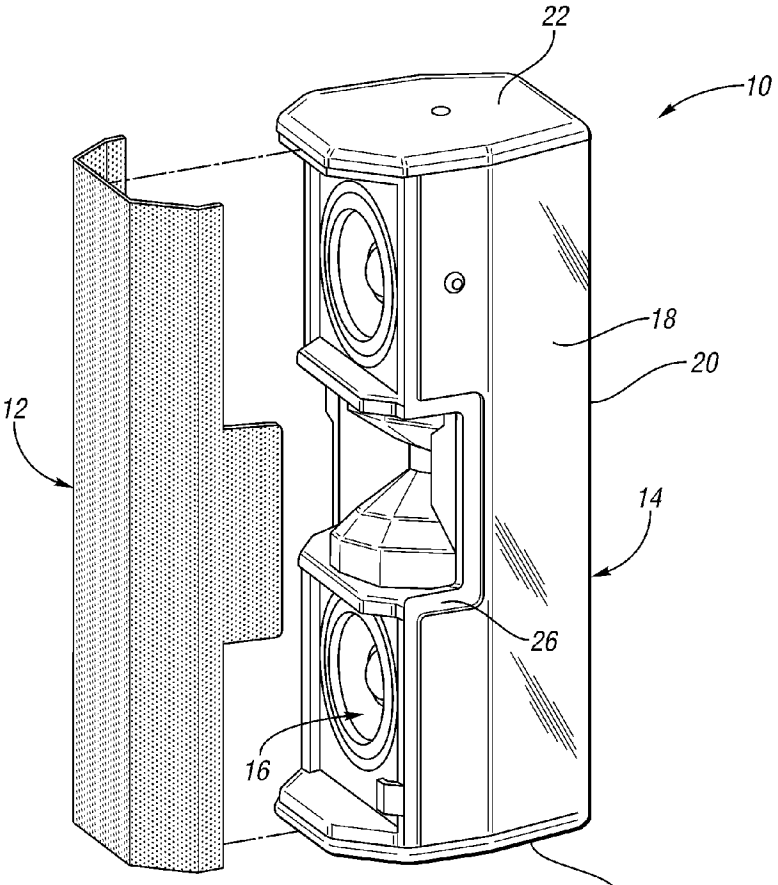
FIG. 2 is an exploded perspective view of a speaker enclosure and speaker grille according to an embodiment.
Figure 1:
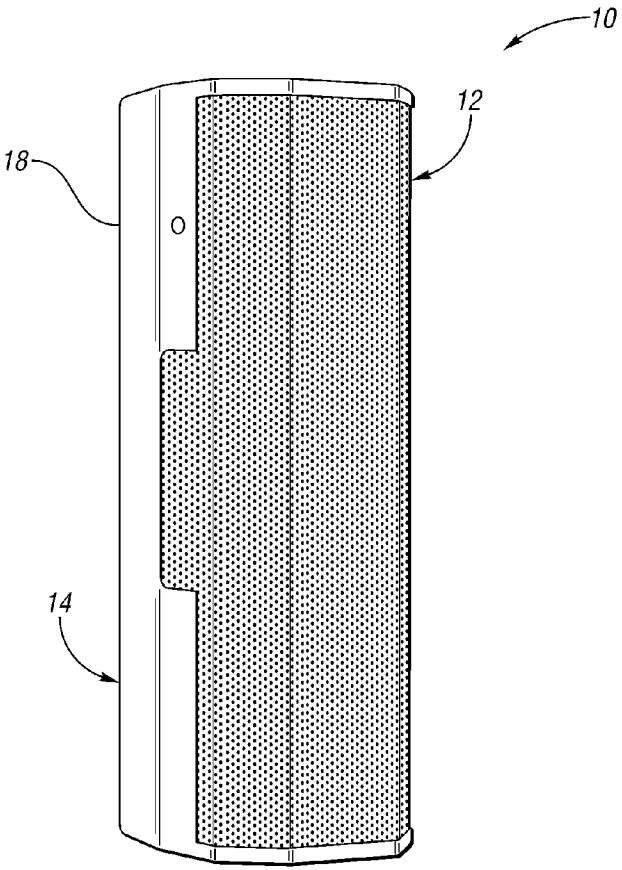
FIG. 1 is a perspective view of a speaker assembly according to an embodiment.
Figure 3:
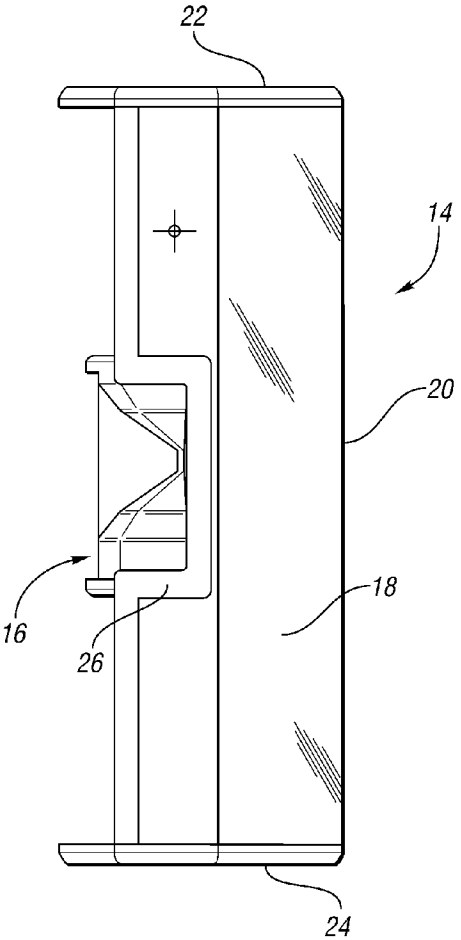
FIG. 3 is a side view of the speaker enclosure.
Figure 6:
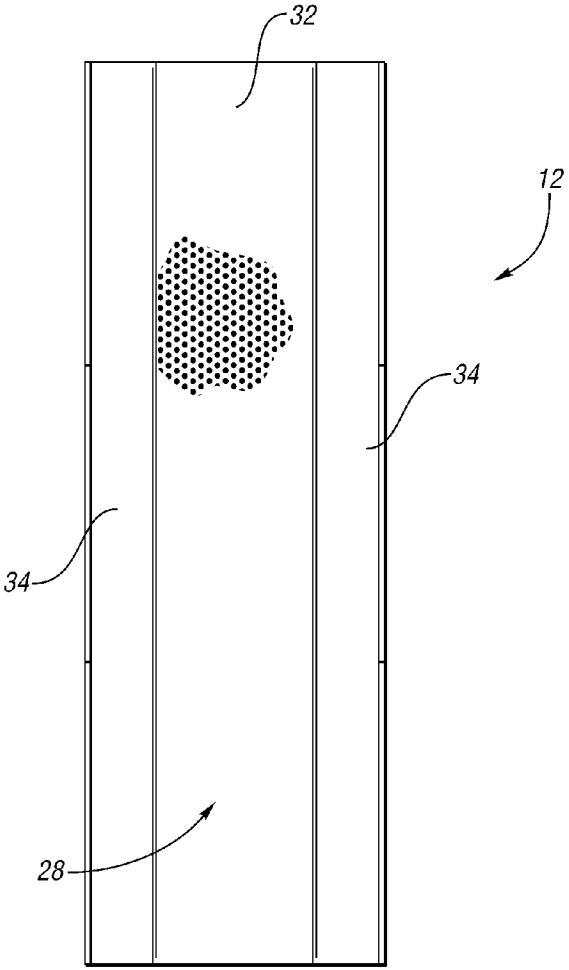
FIG. 6 is a front view of the speaker grille.

FIG. 1 illustrates a speaker assembly 10 comprising a speaker grille 12 and enclosure 14 according to an embodiment, and FIG. 2 is an exploded view of the speaker assembly 10. As shown in FIG. 2, the enclosure 14 is arranged to receive at least one speaker 16 therein, and can be constructed from any suitable material such as, but not limited to, hardwood. The enclosure 14 may include two side panels 18, a rear panel 20, a top panel 22 and a bottom panel 24. In one embodiment, the enclosure 14 may have an open front area to receive the speaker grille 12. As best shown in FIGS. 2 and 3, recesses 26 are provided in each side panel 18 to receive the speaker grille 12 as described further below. In one embodiment, a height of each recess 26 may be approximately ⅓ of a height of the side panel 18, although the recesses 26 are not limited to this configuration. Furthermore, while a particular configuration of the enclosure 14 and speaker 16 is shown, it is understood that other configurations are also contemplated.

As depicted in FIGS. 1 and 2, the speaker grille 12 is arranged to be mounted on the enclosure 14. As best shown in FIGS. 4 and 6-8, the speaker grille 12 includes a front portion 28 and side portions 30 extending from the front portion 28. In one embodiment, the front portion 28 may include a central face 32, and the side portions 30 may extend from the front portion 28 generally perpendicular to the central face 32. The front portion 28 may further include angled peripheral faces 34 on each side of the central face 32 with the central and peripheral faces 32, 34 being generally planar, such that the side portions 30 extend from the peripheral faces 32. In one embodiment, the peripheral faces 32 may have approximately a 45 degree chamfer. Although the front portion 28 and side portions 30 are depicted herein as having generally planar faces, it is understood that the front and side portions could be continuous, such as in the instance of a curved speaker grille.

Figure 4:
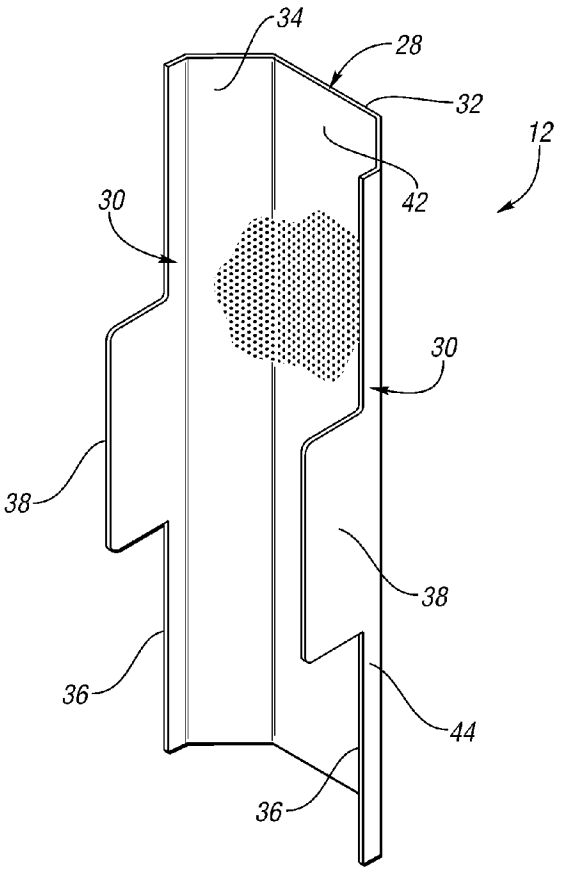
FIG. 4 is a rear perspective view of the speaker grille according to an embodiment.
Figure 7:
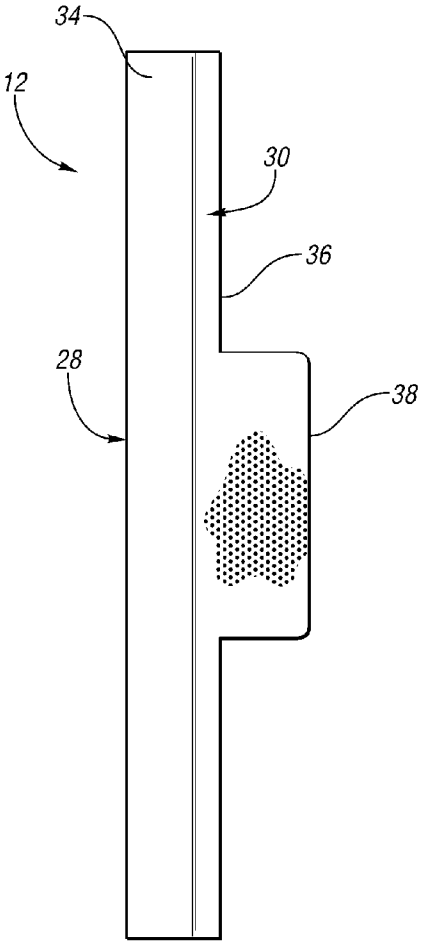
FIG. 7 is a side view of the speaker grille.

As best shown in FIGS. 2, 4 and 7, each side portion 30 has an edge 36 and a projection 38 that extends beyond the edge 36, wherein the projections 38 are arranged to be received in the enclosure recesses 26. In one embodiment, the projection 38 may be generally planar and rectangular, and each projection 38 may extend approximately twice the distance from the central face 32 as does the side portion edge 36. The projection 38 may be disposed in a central region of the side portion 30, which may correspond with speaker horn placement in a wide angle coverage speaker, and the projection 38 may have a height of approximately ⅓ of a height of the side portion 30. Of course, other configurations for the projections 38 are also contemplated.

The front portion 28 and the side portions 30 of the speaker grille 12, including the projections 38, all have substantially similar capability for sound transmission. As such, the wrap around design of the speaker grille 12 with its side portion projections 38 allows for the acoustic passage of sound to a wide angle on both sides of the enclosure 14 to provide coverage angles of up to 180 degrees in the horizontal plane, thus providing an improved acoustic performance.

One function of a speaker grille is to protect a speaker from damage, so the grille should be constructed so as to have a sufficient mechanical strength. However, a speaker grille must also allow for sound transmission. A speaker grille with a greater open area, such as by using more perforations, will allow more sound to pass but will offer less protection from objects or water. A speaker grille with a lesser open area may not allow enough sound to pass, thus distorting the speaker's output.

Figure 5:
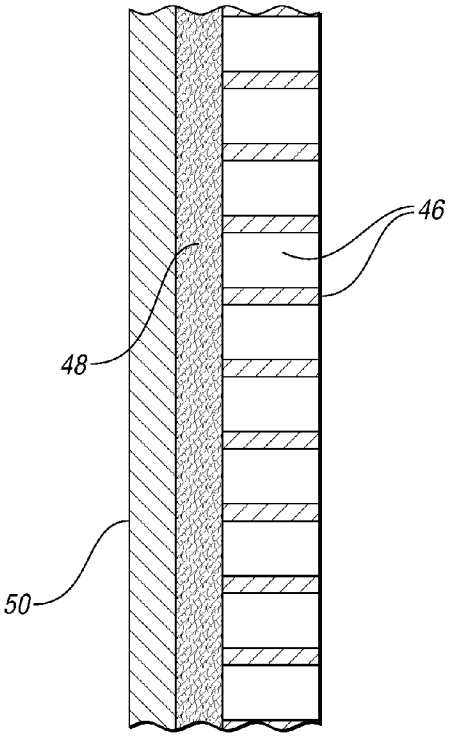
FIG. 5 is a schematic representation of assembly of the speaker grille according to an embodiment.
Figure 8:
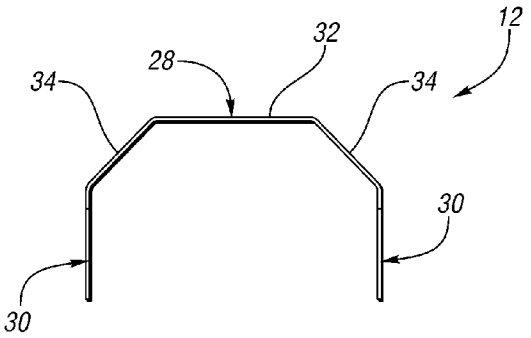
FIG. 8 is a top view of the speaker grille.

To address these competing demands, the speaker grille 12 according to at least one embodiment may include multiple material layers. With reference to FIGS. 4 and 5, the grille 12 has an interior surface 42 and an exterior surface 44 and comprises a perforated metal material 46, wherein the holes or perforations are best shown in FIG. 1. Any suitable number of perforations may be used to form the speaker grille 12. Perforations may be formed in an offset array pattern in which each row of holes is slightly offset from the vertically adjacent row of holes, but can have any suitable pattern. The holes may be relatively uniform in size, shape and location relative to each other. Each hole may have any suitable diameter, may be spaced at any suitable horizontal distance from other holes, and may be spaced at any suitable vertical distance from other holes that form the grille 12. In one embodiment, the perforated metal material 46 may include holes of approximately 0.250" in diameter on 0.03125" staggered centers.

In one embodiment, the maximum open area of the perforated metal material 46 is approximately 65% perforated. The use of 65% open area in the grille 12 provides sufficient material strength to be a protective barrier to prevent physical damage of the speaker 16 while providing fewer reflective surfaces to obstruct the transmission of sound. The exterior surface 44 of the speaker grille 12 may be finished with a thermoplastic powder coating for durability and weather resistance.

In at least one embodiment, the speaker grille 12 further comprises a fabric cloth material 48 attached to the perforated metal material 46 on the interior surface 42 of the grille 12. The fabric cloth material 48 may function to hide speaker components as well as to prevent damage to speaker components caused by dust or other airborne particles. The fabric cloth material 48 also provides UV protection.

In at least one embodiment, the speaker grille 12 further comprises a metal cloth material 50 such as, but not limited to, a stainless steel mesh, attached to the fabric cloth material 48 such that the fabric cloth material 48 is disposed between the metal cloth material and the perforated metal material 46. The metal cloth material 50 provides a water break surface to prevent damage to the components via the entrance of rain, either wind driven or direct, through the speaker griller 12 while in use, yet is very transmissible with regard to sound.

The layers of material 46, 48, 50 may be attached by adhesive or any other suitable chemical or mechanical connector. By first attaching the fabric cloth material 48 to the perforated metal material 46 and then followed by attachment of the metal cloth material 50, stronger resistance is provided against water intrusion through the speaker grille 12. In addition, the fabric cloth material 48 serves as a barrier against vibration of the perforated metal material 46 against the metal cloth material 50.

The speaker grille 12 and speaker assembly 10 as described herein can have multiple applications and are designed to work in a variety of performance spaces including performing arts facilities, houses of worship, auditoriums, lecture halls, cinemas, and conference facilities. For larger, public spaces, applications include transportation facilities, theme parks, and sports facilities.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A speaker grille, comprising:

a front portion capable of sound transmission; and side portions extending from the front portion, each side portion including an edge and a projection that extends beyond the edge in a plane of the side portion, each side portion having a substantially similar capability for sound transmission as the front portion.

2. The speaker grille of claim 1, wherein the front portion has a central face and the side portions extend from the front portion generally perpendicular to the central face.

3. The speaker grille of claim 2, wherein the front portion includes angled peripheral faces on each side of the central face, the central and peripheral faces being generally planar, and the side portions extend from the peripheral faces.

4. The speaker grille of claim 2, wherein the projection extends approximately twice the distance from the central face as does the side portion edge.

5. The speaker grille of claim 1, wherein the projection is disposed in a central region of the side portion.

6. The speaker grille of claim 1, wherein a height of the projection is approximately ⅓ of a height of the side portion.

7. The speaker grille of claim 1, wherein the projection is generally planar and rectangular.

8. The speaker grille of claim 1, wherein the grille comprises a perforated metal material.

9. The speaker grille of claim 8, wherein the grille further comprises a fabric cloth material attached to the perforated metal material on an interior surface of the grille.

10. The speaker grille of claim 9, wherein the grille further comprises a metal cloth material attached to the fabric cloth material, such that the fabric cloth material is disposed between the metal cloth material and the perforated metal material.

11. A speaker grille, comprising:

a body constructed from a perforated metal material, the body having an interior surface, a fabric cloth material attached to the perforated metal material on the interior surface, and a metal cloth material attached to the fabric cloth material such that the fabric cloth material is disposed between the metal cloth material and the perforated metal material.

12. The speaker grille of claim 11, wherein the body includes a front portion capable of sound transmission and side portions extending from the front portion, each side portion including an edge and a projection that extends beyond the edge, each side portion having a substantially similar capability for sound transmission as the front portion.

13. The speaker grille of claim 12, wherein the front portion has a central face and the side portions extend from the front portion generally perpendicular to the central face, wherein the projection extends approximately twice the distance from the central face as does the side portion edge.

14. The speaker grille of claim 12, wherein the projection is disposed in a central region of the side portion.

15. The speaker grille of claim 12, wherein a height of the projection is approximately ⅓ of a height of the side portion.

16. A speaker assembly, comprising:

an enclosure arranged to receive at least one speaker therein, the enclosure having a recess on each side thereof;

a speaker grille arranged to be mounted on the enclosure, the speaker grille including a front portion capable of sound transmission and side portions extending from the front portion, each side portion including an edge and a projection that extends beyond the edge in a plane of the side portion, the projections having a shape complementary to a shape of the enclosure recesses and are arranged to be received in the enclosure recesses, each side portion having a substantially similar capability for sound transmission as the front portion.

17. The speaker assembly of claim 16, wherein the front portion has a central face and the side portions extend from the front portion generally perpendicular to the central face, wherein the projection extends approximately twice the distance from the central face as does the side portion edge.

18. The speaker assembly of claim 16, wherein the projection is disposed in a central region of the side portion.

19. The speaker assembly of claim 16, wherein a height of the projection is approximately ⅓ of a height of the side portion.

20. The speaker assembly of claim 16, wherein the speaker grille comprises a perforated metal material, a fabric cloth material attached to the perforated metal material on an interior surface of the grille, and a metal cloth material attached to the fabric cloth material such that the fabric cloth material is disposed between the metal cloth material and the perforated metal material.

* * * * *